United States Patent [19]

Savio et al.

[11] Patent Number: 4,934,124

[45] Date of Patent: Jun. 19, 1990

[54] METHOD TO FRAME PHOTOGRAPHIC FILMS AND MACHINE EMPLOYING SUCH METHOD

[75] Inventors: Luciano Savio, Pordenone, Italy; Edoardo Facchini, Via Molini 61/3, Cordenons (PN), Italy 33084

[73] Assignee: Edoardo Facchini, Cordenons, Italy

[21] Appl. No.: 311,957

[22] Filed: Feb. 17, 1989

[30] Foreign Application Priority Data

Feb. 19, 1988 [IT] Italy ..... 83320 A/88

[51] Int. Cl.[5] ..... B65B 61/02; B65B 5/04

[52] U.S. Cl. ..... 53/411; 53/131

[58] Field of Search ..... 53/411, 131, 435, 520, 53/457, 266 A, 457, 564; 400/30; 29/417, 564.6

[56] References Cited

U.S. PATENT DOCUMENTS

| | | | |
|---|---|---|---|
| 2,819,656 | 1/1958 | Patterson . | |
| 3,521,423 | 7/1970 | Koeppe et al. | 53/457 X |
| 3,807,121 | 4/1974 | Mundt et al. | 53/435 |
| 4,004,340 | 1/1977 | Urban | 53/520 X |
| 4,102,029 | 7/1978 | Thompson | 53/520 X |
| 4,135,343 | 1/1979 | Urban et al. | 53/435 |
| 4,395,144 | 7/1983 | Adams et al. . | |
| 4,561,167 | 12/1985 | Saito | 53/520 |

FOREIGN PATENT DOCUMENTS 2135556 1/1973 Fed. Rep. of Germany .

*Primary Examiner*—Horace M. Culver

*Attorney, Agent, or Firm*—Wegner & Bretschneider

[57] ABSTRACT

Method to frame photographic films (21) which are fed to a framing station (17) in which the films (21) are divided into single photographs (22) which are inserted into empty frames (12), which arrive at the framing station (17) on a second conveyor (20) that passes in a direction at a right angle to the direction of feed of the photographic films (21), the empty frames (12) being fed to the framing station (17) as they are withdrawn from storage containers (13), the frames containing the photographs (23) being required to include written imprinted messages (19–119) before being suitably stored in final bins, the written messages (19–119) being imprinted on the empty frames (12) while the latter (12) pass along a first conveyor (15) that connects the storage containers (13) to the second conveyor (20), the first conveyor (15) passing in a direction at a right angle to the direction of feed of the second conveyor (20).

11 Claims, 1 Drawing Sheet

METHOD TO FRAME PHOTOGRAPHIC FILMS AND MACHINE EMPLOYING SUCH METHOD

This invention concerns a method to frame photographic films. To be more exact, the invention concerns a method which provides for the imprinting of written messages on frames that feed a station to frame photographic films.

The invention concerns also a machine which employs such method.

The state of the art covers methods and machines to frame photographic films.

A zone to store and feed frames, a station to frame the photographs in the frames and a zone for discharge into appropriate containers are provided.

The zone to store and feed frames consists of one or more vertical containers in which the frames are stored one on another.

The frames are withdrawn automatically one after another from the respective container and are taken to feed the framing zone. When the feeder container is empty, it is replaced by an equivalent container full of frames or is filled again with frames if it is the only container in the storage and feed zone.

The frames one by one feed a framing station in a direction at a right angle to the feed of the photographic films.

When a photograph has been inserted into a frame, the latter is sent to a discharge hopper of the framing machine. The hopper is connected to a device outside the framing machine; this device takes the frames and sends them to stations where written messages are imprinted on the frames.

A final store to hold the frames is included at the outlet from the imprinting stations.

The working method and lay-out of the above apparatus entails a plurality of problems. The inclusion of two separate machines to perform the framing and to imprint written messages on the frames involves difficulties for the machine operator both as regards the operation of the machines and the handling of the materials being fed and the material packaged (photographic films, empty frames, and frames holding photographs).

Moreover, as photographic films belonging to different work orders are normally framed in succession, a heavy drop in the output of the framing machine takes place at each change of work order.

In fact before starting the processing of a new order the machine has to wait for completion of the step to imprint the written messages on the frames of the preceding order.

The present applicant has studied, tested and obtained a method and a machine which are suitable to overcome the problems of the state of the art.

According to the invention the frames are sent from one or more storage containers on the framing machine along a feed path to a framing station. Means are located on this path which are able to imprint written messages on required parts of the frames.

In this way the frames reach the framing station with the messages already imprinted. The imprinted frames are forwarded from the framing station to storage bins located on the working front of the machine and forming part of the machine.

These storage bins may be stationary or movable to ensure greater working capacity of the machine and to restrict the need for action by the operator.

Means for final closure of the frame, which was open beforehand in the framing station for insertion of the respective photograph, may be included between the framing station and the storage bins holding the framed photographs.

The invention is therefore obtained with a method to frame photographic films according to the features of claim 1 and the dependent claims up to claim 8 inclusive, while the invention is embodied with a framing machine according to the features of claim 9.

The attached figures are given as a non-restrictive example and show the following:

A framing machine 10 includes a zone 11 to store and feed empty frames 12. A storage container 13 in which the empty frames 12 are stacked vertically is included in that zone 11 on the framing machine 10.

Figure 1:
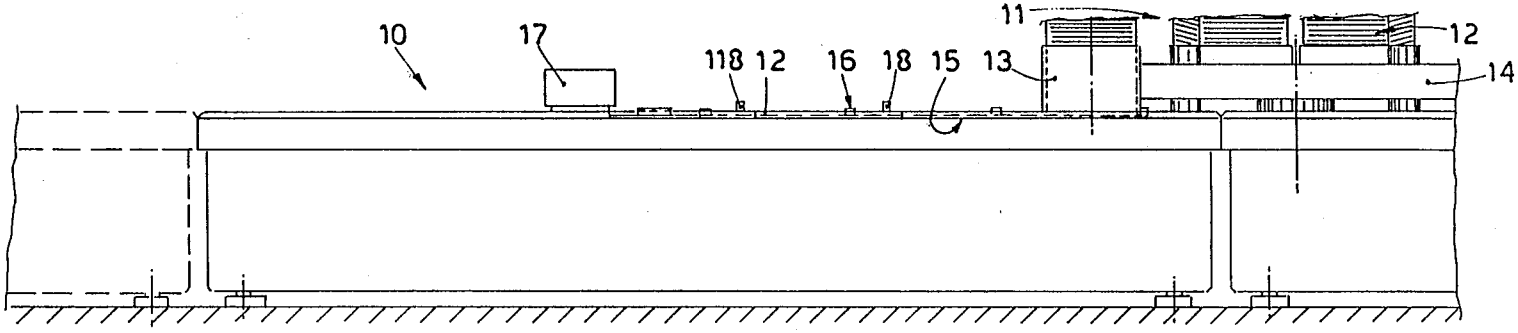
FIG. 1 shows a diagrammatic front view of a framing machine employing the method according to the invention.
Figure 2:
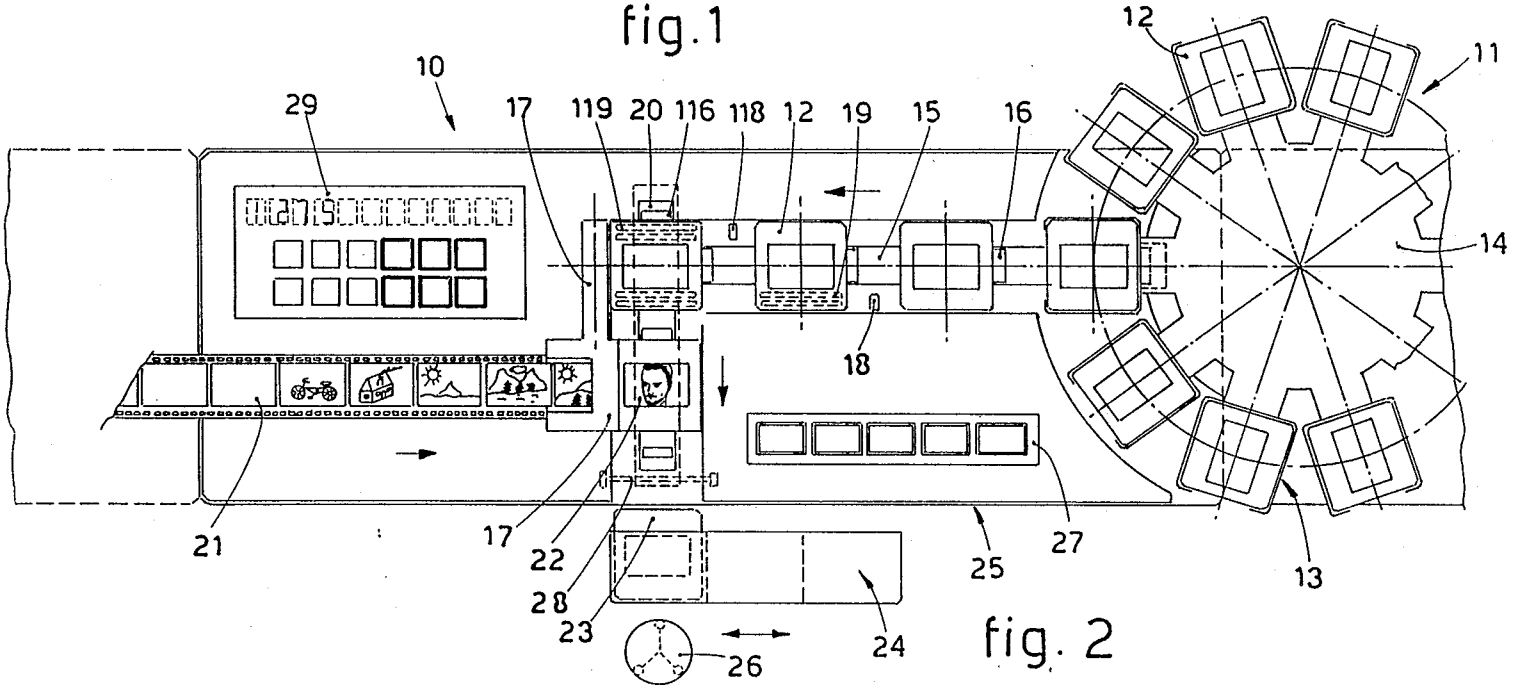
FIG. 2 shows a plan view of the lay-out of FIG. 1.

This storage container 13 is advantageously a part of an automatic feed system comprising a plurality of storage containers 13 fitted, for instance, on a turntable 14 as shown in FIGS. 1 and 2 to ensure a great working capacity as regards the feeding of empty frames 12 to the framing machine 10.

The empty frames 12 are withdrawn one by one from the storage containers 13 and are conveyed on a first conveyor 15 equipped with rollers 16 to draw the empty frames 12.

This first conveyor 15 forms a path for the passage of the empty frames 12 towards a framing station 17. Imprinting means 18 and 118 in FIGS. 1 and 2 are positioned on this path and are suitable to imprint desired written messages 19–119 on the frames 12.

The imprinting means 18–118, which may be one or two or more in number as required, consist generally of small heads comprising needles, or numerators or stamping means, or anything else suitable to be prepared on the site so as to imprint the required messages.

The imprinting means 18–118 are positioned advantageously in a stationary manner in relation to the first conveyor 15, and the feed of the empty frames 12 below the imprinting means 18–118 leads to the impression of the required written messages 19–119.

The first conveyor 15 cooperates at its terminal position in its direction of feed with a second conveyor 20, which is arranged advantageously in a direction at a right angle to the first conveyor 15 and comprises rollers 116 to convey empty frames 12 toward the framing station 17.

The first conveyor 15 and second conveyor 20 are capable of a reciprocally coordinated step-by-step movement with frequency of feed depending on the speed of feed of photographic film 21 or, more exactly, on the speed of insertion of individual photographs 22 in the frames 12.

The feed of the photographic film 21 to the framing station 17 takes place in a direction at a right angle to the feed of the frames 12, as in the state of the art.

The second conveyor 20 arranges also to discharge the frames complete with photographs 23 when the framing operation in the framing station 17 has been carried out. The frames complete with photographs 23 are discharged into a storage bin 24 forming part of the framing machine 10.

The storage bin 24 may be stationary in relation to the framing machine 10 and may comprise a container which, when full, can be discharged by the machine operator, whose working position at the front 25 of the framing machine 10 is indicated with 26.

The storage bin 24 may also be able to move crosswise to the front 25 of the machine and will comprise in that case a set of containers (see FIG. 2) able to increase the working capacity of the framing machine 10.

If so required, there may also be comprised, after the framing station 17 and before the storage bin 24, an auxiliary means 28 to close the frames complete with photographs 23, for instance a freely rotatable roller suitably coated with a non-stick material, as shown with lines of dashes in FIG. 2.

FIG. 2 shows also on the framing machine 10 a panel 29 to control the functions of the machine and a push-button panel 27.

We claim:

1. A method for imprinting frames for framing photographs said method comprising:

feeding empty frames along a first conveyor to a second conveyor;

imprinting a written message on to the empty frames while the empty frames pass along the first conveyor;

feeding the imprinted empty frames along a second conveyor from the first conveyor to framing means, such that a direction of feeding along the second conveyor is perpendicular to a direction of feeding along the first conveyor;

feeding photographic film to the framing means, wherein the photographic film is fed to the framing means at a direction perpendicular to the direction of feeding along the second conveyor; and inserting a single photograph from the photographic film into an individual empty frame at the framing means.

2. The method of claim 1, further comprising feeding the empty frames from storage means for holding emtpy frames to the first conveyor.

3. The method of claim 2, further including closing the frames after they contain photographs.

4. The method of claim 2, further including storing the frames after they contain photographs.

5. An apparatus for imprinting a plurality of frames for framing photographs, said appratus comprising:

storage means for storing empty frames;

a first conveyor and a second conveyor position such that a direction of feeding along the first conveyor is perpendicular to a direction of feeding along the second conveyor, wherein the first conveyor feeds empty frames from the storage means to the second conveyor;

imprinting means along the first conveyor for imprinting a written message on the empty frames;

framing means along the second conveyor for inserting a single photograph of photographic film into an empty frame;

and film feeding means for feeding the photographic film to the framing means, such that a direction of feeding of the film feeding means is perpendicular to the direction of feeding along the second conveyor.

6. The apparatus of claim 5, wherein the imprinting means cooperates with the empty frames positioned on the first conveyor.

7. The apparatus of claim 5, further including means for storing framed photographs, such that the means for storing framed photographs cooperates with the second conveyor such that framed photographs are received from the framing means.

8. The apparatus of claim 7, wherein the means for storing framed photographs is in a stationary position in relation to a point of discharge of the frame photographs by the second conveyor.

9. The apparatus of claim 7, wherein the means for storing framed photographs is in a position transversely movable in relation to a point of discharge of the framed photographs by the second conveyor.

10. The apparatus of claim 7, further including means for closing frames which contain photographs positioned between the framing means and the means for storing framed photographs.

11. The apparatus of claim 5, wherein the storage means comprises a plurality of storage containers for holding empty frames and means for automatically feeding empty frames to the first conveyor.

* * * * *